United States Patent [19]

Mirone et al.

[11] Patent Number: 4,649,875

[45] Date of Patent: Mar. 17, 1987

[54] OILTIGHT HYDRAULIC TAPPET FOR CONTROLLING AN INTERNAL COMBUSTION ENGINE VALVE

[75] Inventors: Paolo Mirone; Franco Colanzi, Turin, Italy

[73] Assignee: RIV-SKF Officine di Villar Perosa S.p.A., Italy

[21] Appl. No.: 801,637

[22] Filed: Nov. 25, 1985

[30] Foreign Application Priority Data

Dec. 4, 1984 [IT] Italy ..... 54108/84[U]

[51] Int. Cl.[4] ..... F01L 1/24

[52] U.S. Cl. ..... 123/90.58; 123/90.55

[58] Field of Search ..... 123/90.58, 90.55, 90.56, 123/90.57, 90.46, 90.59

[56] References Cited

U.S. PATENT DOCUMENTS

| | | | |
|---|---|---|---|
| 2,109,815 | 3/1938 | Best | 123/90.58 |
| 2,833,257 | 5/1958 | Lengnick | 123/90.58 |
| 3,495,577 | 2/1970 | Collins | 123/90.58 |
| 3,521,608 | 7/1970 | Scheibe | 123/90.58 |
| 4,397,271 | 8/1983 | Gardner | 123/90.58 |

FOREIGN PATENT DOCUMENTS

| | | | |
|---|---|---|---|
| 146210 | 11/1980 | Japan | 123/90.58 |
| 160106 | 12/1980 | Japan | 123/90.58 |
| 2089923 | 6/1982 | United Kingdom | 123/90.55 |

*Primary Examiner*—Ira S. Lazarus

*Attorney, Agent, or Firm*—Steele, Gould & Fried

[57] ABSTRACT

The hydraulic tappet comprises a cup-shaped body having a cylindrical side wall and a flat bottom wall, a piston element moving axially inside a cavity, formed in the said bottom wall and defining a first pressure chamber, an annular element of deformable material located on the outside of the said piston element and inside the said cylindrical wall, ducts for hydraulically connecting the said second chamber to the said first chamber and on which is fitted an on-off member, and a guide element moving axially inside the said cylindrical wall on the said cup-shaped body and having a side surface and a bottom wall.

10 Claims, 4 Drawing Figures

OILTIGHT HYDRAULIC TAPPET FOR CONTROLLING AN INTERNAL COMBUSTION ENGINE VALVE

BACKGROUND OF THE INVENTION

The present invention relates to an oiltight, hydraulic tappet designed for assembly on a drive, for controlling an internal combustion engine valve.

Hydraulic tappets of the aforementioned type usually comprise a first element, designed to move in relation to the engine frame, and a second element designed to move axially in relation to the first; a variable-volume chamber being formed between the said two elements and having an inlet duct, for operating fluid, the aperture of which is controlled by an on-off member in such a manner that the said fluid flowing into the said chamber causes one of the said elements to move axially in relation to the other, so as to vary the volume of the said chamber and so take up any slack on the kinematic chain on the said drive.

The said variable-volume chamber usually communicates, via appropriate ducts, with a suitable source of operating fluid from the engine.

A major drawback on tappets of the aforementioned type is that they function poorly during initial operation of the engine, owing to the oil inside the said chamber seeping through the mating surfaces of the said first and second elements, when the engine is idle, and owing to the fact that, during initial operation of the engine, the oil pressure on the engine is totally insufficient for ensuring adequate oil supply to the said chamber. On certain known tappets, such drawbacks have been partially solved by providing a second operating fluid chamber communicating hydraulically with the first and designed to preserve a certain amount of operating fluid, even when the engine is idle, thus enabling the said first chamber to be filled with operating fluid more easily, as compared with the aforementioned arrangement, when the engine is started up.

Even on these tappets, however, long-term operation of the engine may result in oil leakage, from the said second chamber, serious enough to jeopardize operation of the tappet. Nor is such leakage, which occurs between the mutually-sliding mating surfaces on the said first and second elements, prevented by providing appropriate sealing members between the same.

SUMMARY OF THE INVENTION

The aim of the present invention is to provide a hydraulic tappet of the aforementioned type, but involving none of the aforementioned drawbacks, i.e. a highly reliable tappet, designed to operate efficiently, even during initial operation of the engine, and requiring no maintenance. The tappet according to the present invention is also highly compact, of straightforward design, and may, therefore, be produced cheaply.

With this aim in view, the present invention relates to a hydraulic tappet for an internal combustion engine, designed for insertion between a control member, such as a cam, and a valve spindle, and comprising a cup-shaped body having a cylindrical side wall and a flat bottom wall, the former designed to slide in a corresponding seat on the engine frame, and the latter to rest on the sid control member; characterised by the fact that it comprises a piston element moving axially inside a cavity, formed in the said bottom wall, and defining, with the said wall, a first pressure chamber which may be filled with oil; an annular element of deformable material, located on the outside of the said piston element and inside the said cylindrical wall on the said cup-shaped body, and defining a second chamber for the said oil; and ducts for hydraulically connecting the said second chamber to the said first chamber, and on which is fitted an on-off member; a guide element moving axially inside the said cylindrical wall on the said cup-shaped body and having a side surface, designed to slide on the inner surface of the said side wall, and a bottom wall, designed to act as a support for the said piston element and for part of the said annular element of deformable material.

BRIEF DESCRIPTION OF THE DRAWINGS

The present invention will now be described, by way of a non-limiting example, with reference to the attached drawings in which.

DETAILED DESCRIPTION OF THE INVENTION

Figure 2:
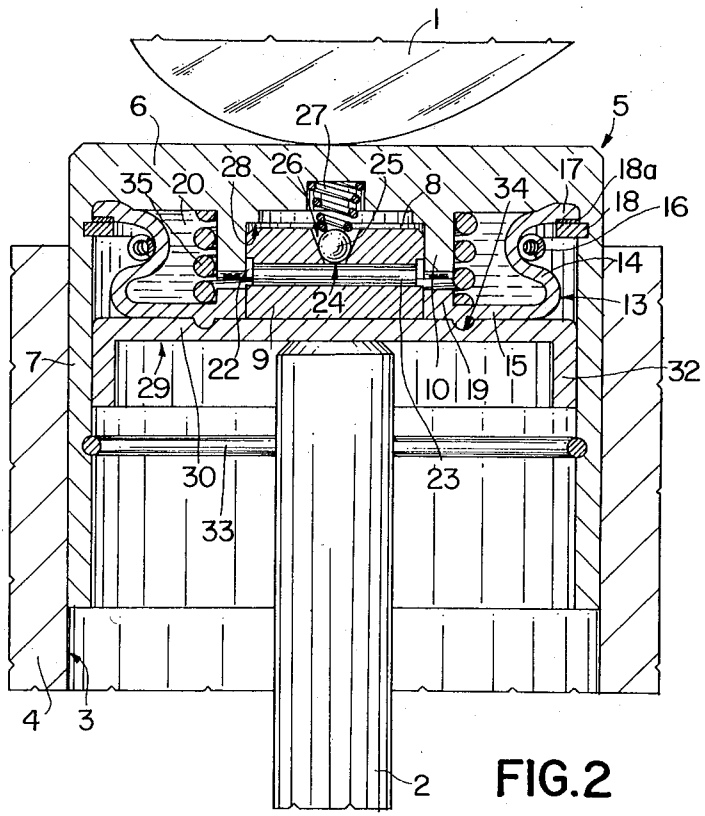
FIG. 2 shows the FIG. 1 tappet in a second operating position.
Figure 1:
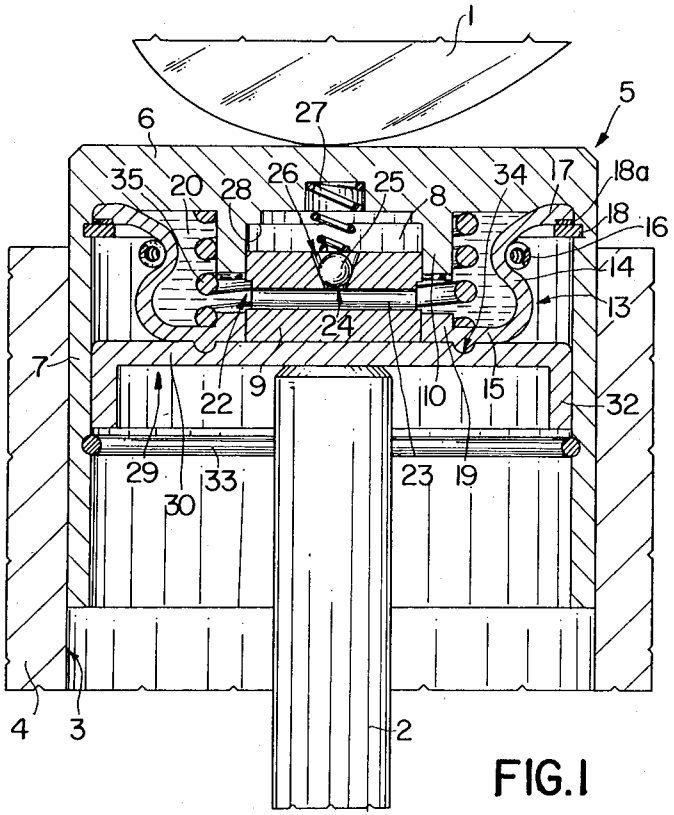
FIG. 1 shows a vertical section of the tappet according to the present invention in a first operating position.

The tappet according to the present invention is designed for assembly between a control member, e.g. cam 1, on an internal combustion engine, and the end of a valve spindle 2 on the same engine, and to slide inside a corresponding seat 3 formed on engine frame 4.

The said tappet essentially comprises a cup-shaped body 5 having an essentially flat bottom wall 6 and a cylindrical side wall 7 designed to slide inside seat 3 on frame 4. Inside cup-shaped body 5, a cavity 8 is formed, inside which slides axially a piston element 9. The said cavity, which may conveniently be extruded or formed inside sleeve 10, in one piece wth bottom wall 6, defines, together with piston element 9, a first chamber 8.

The said tappet also comprises an annular element 13 of deformable material, located outside piston element 9 and inside cup-shaped body 5. The said element 13 conveniently comprises a corrugated side wall 14 and an essentially flat bottom annular wall 15, the outer surface of the said side wall 14 having a spring ring 16 for exerting essentially radial, inward pressure on the said wall 14. The upper annular edge 17 of the said deformable element 13 is essentially connected to bottom wall 6 by means of retaining ring 18, whereas the lower edge 19 of the said element 13 is secured to the outer surface of piston element 9. As deformable element 13 is conveniently made of rubber, edge 19 may be connected to piston element 9 by means of vulcanizing.

Figure 3:
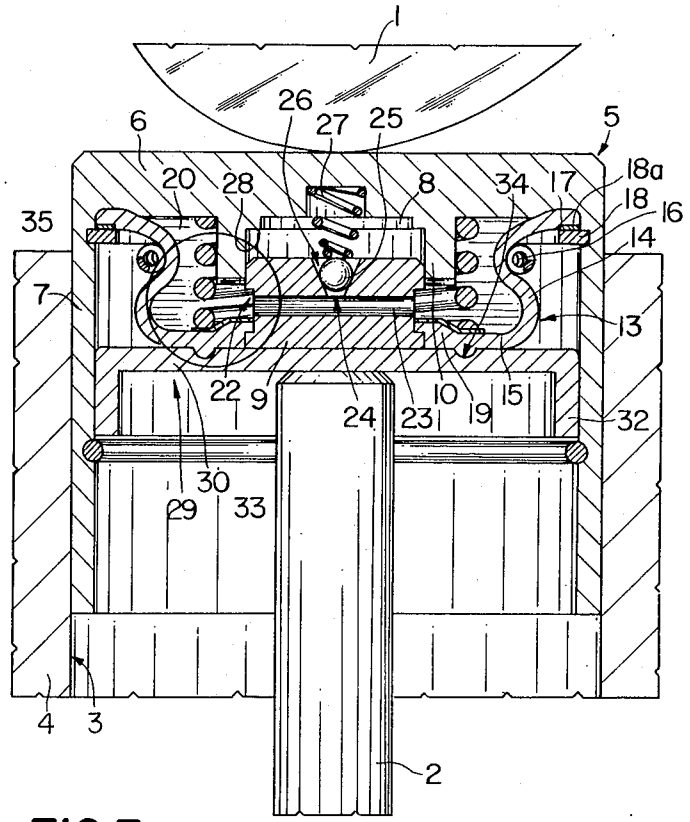
FIG. 3 shows the FIG. 2 tappet with a number of additional design features.
Figure 4:
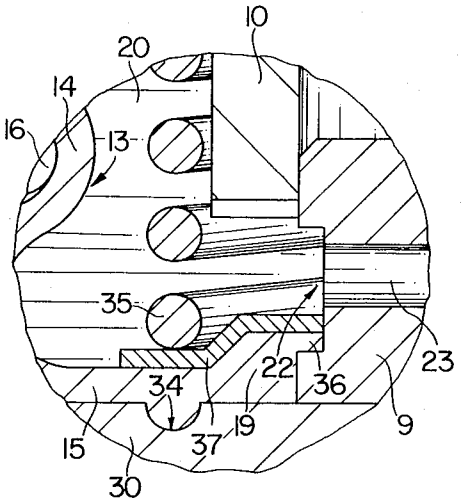
FIG. 4 is an enlarged view of the circled portion of FIG. 3.

According to an alternative method of connecting deformable element 13 to piston element 9, as shown in FIG. 3 (and in detail in FIG. 4), the said element 13 presents an annular lip 36 resting on a corresponding shoulder formed by groove 22. Over the said lip is place a washer 37 on which ests a spring 35.

In like manner, the pressure exerted by spring 35, between lip 36 and its corresponding shoulder, provides for sealing between deformable element 13 and piston element 9. A washer **18*a* may be placed over ring 18**.

Together with bottom wall 6 on cup-shaped body 5, the said deformable element defines a second annular chamber 20 which may be filled with oil and which communicates with the said first chamber 8 via ducts essentially comprising an annular groove 22 and holes 23 and 24 formed inside piston element 9. The said ducts are provided with an on-off member consisting, in the arrangement shown, of a ball 25 designed to rest in a corresponding taper seat 26 formed inside piston element 9. Between the said ball 25 and bottom wall 6 on cup-shaped body 5, a helical spring 27 is conveniently inserted for holding the said ball 25 inside its seat. A shoulder 28 may also be provided, inside cavity 8, for limiting upward displacement of piston element 9.

The said tappet also comprises a quide element 29 designed to slide inside cylindrical wall 7 on cup-shaped body 5.

The said element essentially comprises a flat bottom wall 30, the latter acting as a support for both piston element 9 and bottom annular wall 15 on deformable element 13, and an essentially cylindrical side wall 32 the outer surface of which is designed to mate in sliding manner with the corresponding inner surface of side wall 7 on cup-shaped body 5.

A retaining ring 33, housed inside a corresponding seat on side wall 7, conveniently acts as a downward stop for guide element 29. Furthermore, bottom wall 30 on guide element 29 may conveniently be provided with an annular groove 34 forming a seat for a corresponding annular projection on bottom wall 15 of deformable annular element 13, and spring 35 may be inserted between the said wall and wall 6.

Operation of the tappet according to the present invention is as follows.

When the said tappet is assembled, with piston element 9 essentially contacting shoulder 28 on bottom wall 6 (almost as shown in the FIG. 2 arrangment), second chamber 20 is filled up with oil, and the tappet than fitted on to the drive, between cam 1 and valve spindle 2, as shown in FIG. 2.

During operation of the engine, any slack on the said drive, resulting from wear on its component parts produced by thermal expansion or other factors, is effectively taken up by the tappet according to the present invention. In the event of a change in the mutual axial position of valve spindle 2 and cam 1, oil from second chamber 20 flows through groove 22 and holes 23 and 25 into first chamber 8, thus causing piston element 9 to move axially away from bottom wall 6 on cup-shaped body 5, until the said slack is taken up. Once chamber 8 has been filled with a given amount of oil, this is prevented from flowing back through the on-off member, consisting of ball 25 and respective seat 26, so that considerable force may be transmitted by the tappet between cam 1 and valve spindle 2. When the engine is left idle, the oil inside chamber 8 tends to seep back into chamber 20 between the mating surfaces on piston element 9 and sleeve 10. When the engine is started up, however, by virture of the pressure exerted by spring 16 on side wall 14 of deformable annular element 13, and the vacuum formed inside chamber 8 by spring 35, the oil inside chamber 20, which is at a given pressure, is forced into chamber 8 in such a manner as to cause bottom wall 6 on cup-shaped body 5 to contact cam 1, and bottom wall 30 on guide element 29 to contact valve spindle 2.

Obviously, therefore, during operation of the tappet, absolutely no oil leakage is possible, in that, oil is only allowed to flow between chambers 8 and 20. Nor may it seep through deformable annular element 13, by virtue of the upper and lower edges, 17 and 19, of the said element being sealed to the rest of the tappet.

Axial displacement of piston element 9 inside sleeve 10 has also proved to be extremely accurate, the axis of the said element essentially coinciding at all times with the axis of cup-shaped body 5, by virtue of the guiding action exerted by quide element 29. Even though, on account of the small diameter and limited height of the said piston element 9, fairly little guiding action is exerted by the outer surface of piston element 9 mating with the inner surface of sleeve 10, piston element 9 is guided perfectly by the action exerted on it by guide element 29. Piston element 9, in fact, presents a lower surface of considerable area, which rests correctly on the upper surface of bottom wall 30 on guide element 29. As the latter is effectively guided on cup-shaped body 5 by virture of mating side walls 32 and 7, displacment of piston element 9 is, therefore, perfectly smooth and accurate. Downward displacement of guide element 29 is also facilitated by helical spring 35 which forces it down on to valve spindle 2.

In addition to providing for immediate take-up of any slack on the drive of which it forms part, the tappet according to the present invention also provides for reliable, troublefree operation in terms of both precise mutual displacement of its component parts and perfect hydraulic sealing preventing any possibility of oil leakage to the outside.

The tappet according to the present invention is also of straightforward, compact design, by virtue of the simplicity of its component parts and the ease with which the latter may be assembled.

To those skilled in the art it will be clear that changes may be made to the tappet as described herein without, however, departing from the scope of the present invention.

We claim:

1. Hydraulic tappet for an internal combustion engine, designed for insertion between a contol member, such as a cam, and a valve spindle, and comprising a cup-shaped body having a cylindrical side wall and a flat bottom wall, the former designed to slide in a corresponding seat on the engine frame, and the latter to rest on the said control member; characterised by the fact that it comprises a piston element moving axially inside a cavity, formed in the said bottom wall, and defining, with the said wall, a first pressure chamber which may be filled with oil; an annular element of deformable material, located on the outside of the said piston element and inside the said cylindrical wall on the said cup-shaped body, and defining a second chamber for the said oil; and ducts for hydraulically connecting the said second chamber to the said first chamber, and on which is fitted an on-off member; a guide element moving axially inside the said cylindrical wall on the said cup-shaped body and having a side surface, designed to slide on the inner surface of the said side wall, and a bottom wall, designed to act as a support for the said piston element and for part of the said annular element of deformable material.

2. Tappet according to claim 1, characterised by the fact that the said guide element comprises an annular side wall having the said side surface designed to slide over the inner surface of the said side wall on the said cup-shaped body.

3. Tappet according to claim 1, characterised by the fact that the said annular element of deformable material comprises a corrugated side wall and an essentially flat, bottom annular wall designed to rest on the said bottom wall of the said guide element; the outer surface of the said side wall on the said annular element being provided with a spring for exerting radial pressure on the wall itself.

4. Tappet according to claim 1, characterised by the fact that the said annular element of deformable material comprises an upper annular edge secured to the said bottom wall on the said cup-shaped body, and a lower annular edge connected to the side wall on the said piston element.

5. Tappet according to claim 4, characterised by the fact that the said annular element of deformable material is made of rubber; the said upper annular edge being secured by means of a retaining ring, and the said lower annular edge being secured by means of vulcanizing.

6. Tappet according to claim 4, characterised by the fact that the said lower annular edge of the said deformable element is secured to the said piston element by means of an annular projection formed on the edge itself, and by means of an annular shoulder formed on the said piston element and designed to act as a support for the said annular projection, the latter being forced against the said shoulder by a spring resting on a washer on the said annular edge.

7. Tappet according to claim 1, characterised by the fact that the said cavity formed in the said bottom wall of the said cup-shaped body is achieved by means of a sleeve formed in one piece with the wall itself or by means of extrusion.

8. Tappet according to claim 1, characterised by the fact that the said on-off member comprises a ball designed to rest in a taper seat formed on top of the said piston element; a helical spring being inserted between the said ball and the said bottom wall on the said cup-shaped body for the purpose of keeping the said ball inside the said seat.

9. Tappet according to claim 1, characterised by the fact that a second helical spring is inserted between the said bottom wall on the said cup-shaped body and the said annular wall on the said deformable element.

10. Tappet acording to claim 1, characterised by the fact that it comprises a retaining ring mounted inside a seat on the said side wall on the said cup-shaped body and designed to arrest downward axial displacement of the said guide element.

* * * * *

UNITED STATES PATENT AND TRADEMARK OFFICE

CERTIFICATE OF CORRECTION

PATENT NO. : 4,649,875

DATED : March 17, 1987

INVENTOR(S) : Paolo Mirone and Franco Colanzi

It is certified that error appears in the above-identified patent and that said Letters Patent is hereby corrected as shown below:

Column 2, line 64, delete "ests" and insert --rests--.

Signed and Sealed this

Eighth Day of September, 1987

*Attest:*

DONALD J. QUIGG

*Attesting Officer*

*Commissioner of Patents and Trademarks*